United States Patent [19]

Hiles

[11] Patent Number: 4,777,739

[45] Date of Patent: Oct. 18, 1988

[54] SHOCK ABSORBING STRUCTURES

[75] Inventor: Maurice Hiles, Munroe Falls, Ohio

[73] Assignee: Hamilton Kent Manufacturing Company, Inc., Kent, Ohio

[21] Appl. No.: 296,446

[22] Filed: Aug. 26, 1981

[30] Foreign Application Priority Data

Aug. 26, 1980 [GB] United Kingdom ..... 8037552

[51] Int. Cl.[4] ..... A43B 13/40

[52] U.S. Cl. ..... 36/43; 36/44

[58] Field of Search ..... 36/28, 29, 30 R, 31, 36/30 A, 44, 43, 35 B; 267/117, 118, 140.1, 152, 153; 188/270; 248/562, 631

[56] References Cited

U.S. PATENT DOCUMENTS

| | | | |
|---|---|---|---|
| 975,576 | 11/1910 | Sexton | 36/43 |
| 1,597,672 | 8/1926 | Dahlquist | 36/44 |
| 1,843,893 | 2/1932 | Becher | 267/117 |
| 3,418,731 | 12/1968 | Anciaux | 36/30 R |
| 3,624,930 | 12/1971 | Johnson et al. | 36/43 |
| 4,000,566 | 1/1977 | Famolare | 36/28 |
| 4,008,530 | 2/1977 | Gager | 36/29 |
| 4,129,951 | 12/1978 | Petrosky | 36/29 |
| 4,170,078 | 10/1979 | Moss | 36/29 |
| 4,223,455 | 9/1980 | Vermeulen | 36/29 |

FOREIGN PATENT DOCUMENTS

| | | | |
|---|---|---|---|
| 2460034 | 6/1976 | Fed. Rep. of Germany | 36/29 |
| 626017 | 4/1927 | France | 36/43 |
| 742302 | 3/1933 | France | 36/44 |
| 837363 | 2/1939 | France | 36/43 |
| 1218309 | 5/1960 | France | 36/44 |
| 1564195 | 4/1980 | United Kingdom | 528/53 |

*Primary Examiner*—Steven N. Meyers

*Attorney, Agent, or Firm*—Renner, Otto, Boisselle & Sklar

[57] ABSTRACT

Shock absorbing structures suitable for footware and the like may utilize a flexible polyurethane of essentially linear structure containing unsatisfied hydroxyl groups and having a compression set of less than 15%, an elongation break of at least 500%, and a recovery which is delayed after compression by at least 0.7 seconds. The structures include a block or layer with one or more fluid cavities, each cavity having one or more relatively small passageways communicating the cavity with the exterior of the block or layer. The cavities may be closed by a separate layer bonded to the block or layer. In footware, the cavities may be strategically located and circular or rectangular in form with the passageways being similarly shaped and extending through the top of the layer or block.

3 Claims, 2 Drawing Sheets

SHOCK ABSORBING STRUCTURES

Figure 1:
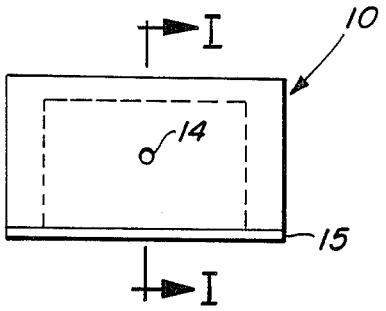

Shock absorbing structures are employed in a variety of practical applications of which typical examples are those of packaging and sports footwear. Current usage frequently involves foamed elastomeric and other plastics materials of varying forms, elastomeric materials being appropriate when repeated shock absorbing capability is required, as in footwear, and other materials being appropriate when a much lesser frequency of impact is likely, as in packaging.

However, despite the variety of such materials in different applications, limitations arise in connection with control of the capabilities of these materials as presently employed. Among these limitations is the fact that the shock absorbing capabilities are determined predominantly by the material manufacturing process. Also, cell collapse within a foamed material often results in an unacceptably high compression set for the purposes of many applications. In addition, variation of capability occurs within a given piece of material with variation of cell size affecting elastic modulus, and with variation of cell wall thickness affecting compression set by way of cell fracture level.

In this context a clear benefit resides in providing an enhanced degree of control over the capabilities of a shock absorbing structure and to this end an improved structure of this kind is made of elastomeric material defining a fluid-containing cavity therein with at least one dimension of a similar order of size to the corresponding dimension of said material bordering thereon, and said cavity being communicated with the exterior of the structure by one or more passageways each having at least one cross-sectional dimension which is small relative to the corresponding dimension of said cavity.

Normally, the overall cross-sectional dimensions of each passageway will be small compared to those of its cavity.

It is to be understood that the shock absorbing capabilities of the structure just proposed are not determined by those of the elastomeric material alone but by the latter in association with the physical properties of the fluid, and the geometry of the structure, cavity and passageways. The fluid properties will be substantially uniform and predictable, and the geometry is readily predetermined, and so the overall capabilities are generally more controllable than is the case with the prior structures.

The cavity may be open on one side thereof, with this side being substantially closed by the surface of another member employed in association with the structure.

The fluid in the cavity is suitably air, with each passageway venting the same to atmosphere, but other gas or liquid may be appropriate in some circumstances.

The elastomeric material preferably does not have such a high elastic modulus as to quickly return much of any impact energy imparted thereto by a shock; on the contrary, the material preferably has a delayed recovery after distortion. Also, it is preferred that the material has a low compression set and for many applications this ideally should approach zero. In these two respects materials such as described in Patent Specification No. 1,564,195 and U.S. Pat. No. 4,346,205, the latter of which is incorporated herein by reference are particularly suitable, but not exclusively so.

Figure 2:
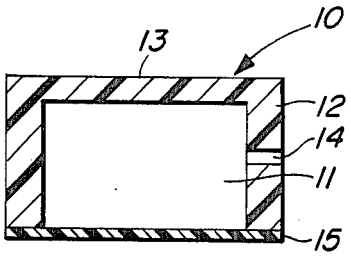
Figure 3:
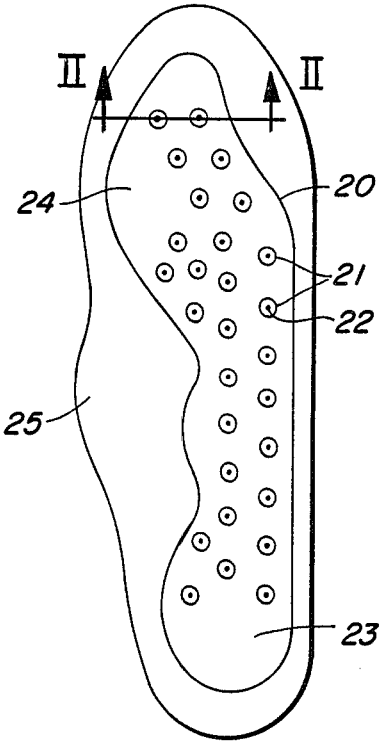
Figure 5:
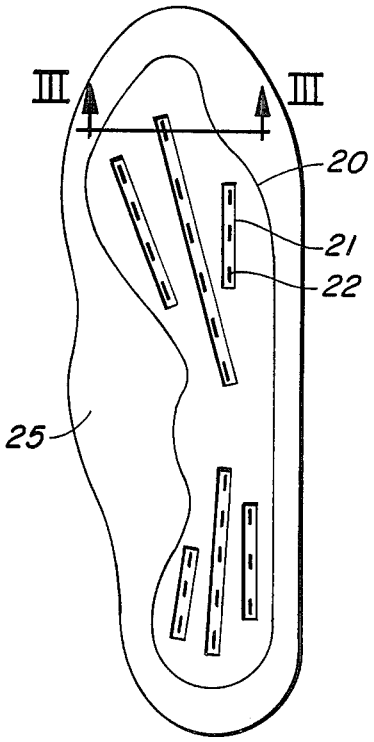
Figure 4:
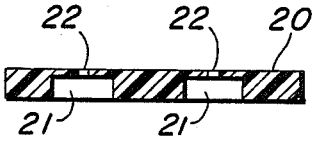
Figure 6:
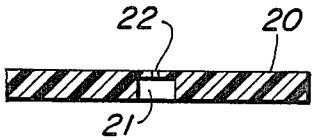
Figure 7:
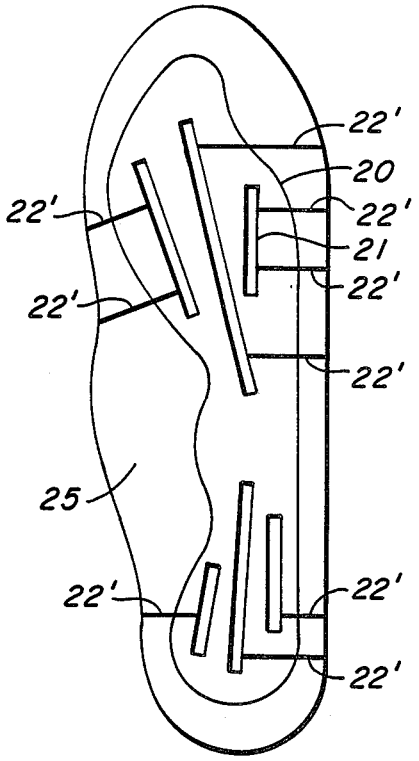

Clarification and further consideration of the present invention is made with reference to the accompanying drawings which are given by way of example, and in which:

FIGS. 1 and 2 schematically illustrate in a side view and a sectional view at I—I thereof, respectively, a simple structure according to the invention, FIGS. 3 and 4 schematically illustrate in underneath plan view and an enlarged sectional view at II—II thereof, respectively, one embodiment of the invention for use in footwear, FIGS. 5 and 6 are respectively a similar underneath plan view and sectional view at III—III of another such embodiment, and FIG. 7 is an underneath plan view of another embodiment of the invention.

The structure of FIGS. 1 and 2 is intended primarily to illustrate the functional properties of the invention rather than a specific practical embodiment thereof and its description will accordingly be of a very generalised form.

The relevant structure in fact comprises simply a block 10 of elastomeric material having a cavity 11 formed therein from one side to leave a generally annular side wall 12 and an end wall 13. The cavity has at least one dimension, the same order of size as the corresponding dimension of the block and, in the present case, this is seen to be so for both the width and height in FIG. 2.

The block is additionally formed with a passageway 14 to communicate the cavity with the exterior of the block, this passageway having overall cross-sectional dimensions which are small relative to the corresponding dimensions of the block. In this instance the passageway is located in the side wall of the block and its dimensions are seen from FIG. 1 to be as just qualified.

Lastly, the cavity is closed, except for the passageway 14, by the location across the open part of the block of a member 15. This member may be a membrane or sheet of any material, although suitably it is common with the block, secured to the block as a permanent part of the structure. Alternatively, the member 15 may represent part of an object against which the block is located in a permanent or separable manner, and in respect of which a shock absorbing capability is to be afforded.

Given that this structure is intended to absorb a shock impact thereon, it will be seen that the structure can compress in stages subject to different controlling factors. Generally speaking the structure will compress in a first phase during which it is distorted to drive air from its cavity to atmosphere by way of the passageway, until the passageway is closed by the distortion to lead to a second phase.

During the first phase the rate at which air is vented will depend on various factors. Firstly the small cross-sectional size of the passageway will tend to produce a throttling effect with a consequent presurisation of the cavity. Secondly, this will be compounded by variation of the cross-sectional shape of the passageway: a circular shape will progressively reduce in area with compression, laterally elongated shapes will so reduce more rapidly, and the latter shape when orientated through 90° will first increase in area before reducing. Thirdly, the location of the passageway will have an effect, locations nearer to the member tending to be subject to change in a delayed manner compared to more remote locations.

During the second phase the structure will continue to compress with increase of cavity pressure until the air is less compressible than the elastomeric material, whereafter the properties of the material dominate further change.

Clearly this situation gives considerably greater scope for variation of shock absorbing capabilities for a given elastomeric material compared to the use of the material alone in an effectively homogeneous structure, and these variations are open to greater control.

Turning to the embodiments of the remaining figures, these are each intended to serve as an insole for location in a shoe to provide different shock absorbing capability below different parts of the wearer's foot. Each insole comprises a suitably shaped layer 20 of substantially uniform thickness of an elastomeric material according to the above-mentioned Specification No. 1,564,195 and U.S. Pat. No. 4,346,205, the latter of which is incorporated herein by reference. Each layer 20 is provided with a plurality of cavities or recesses 21 opening into the layer from below, and each cavity is vented to the upper surface of the layer by one or more passageways 22. The size of each cavity compares with that of the layer, and each passageway with its cavity, as discussed above so that the cavities influence the shock absorbing properties of the layer on a local basis. In addition the cavities influence the overall shock absorbing capability of the layer by allowing distortion of the elastomeric material to occur which may not otherwise be possible. In the result the layer has varying capability thereover and this variation can be deployed in different ways in a controlled manner to suit differing requirements suited to normal footwear in walking, sports footwear in running and other such activity, and surgical and remedial footwear having special requirements. In the particular illustrated embodiments, that of FIGS. 3 and 4 has substantially circular cylindrical cavities with respective singular passageways of corresponding shape, with the cavities being in a generally closely packed array over the layer except for two areas 23 and 24 which may correspond to location below portions of the heel and ball of the foot. This may suit normal walking. The embodiment of FIGS. 5 and 6 involves slot form cavities, each with a plurality of similarly shaped passageways, and with the cavities distributed generally longitudinally and more evenly over the layer. This is thought is suit sports activity.

It is to be noted that the plan shapes of these embodiments need not necessarily conform to the whole of a foot insofar as the whole area below the foot may not require shock protection. However, it may well be appropriate to complete the shape in this respect to assist in maintaining a desired location for the layer when used in a shoe. Accordingly the layer 20 may be extended by an area 25 of different material having a much lesser shock absorbing capability.

In one example of such an extension the layer 20 is extended by a circumscribing layer 25 of a foamed cross linked polyethylene, with the two layers being held in place by bonding to a common felt or other pervious layer thereover. The layer 25 in this instance is of a material having a significantly higher compression set than that of the layer 20 and so quickly permanently compacts to conform with the adjacent areas of the foot. Also, this material contributes little weight to the overall insole. Development of such a composite insole indicates no difficulty arising by way of user discomfort as a result of the dissimilar material properties at the junction region between layers 20 and 25, although tests suggest that the layer 20 should be slightly thicker, by 1 or 2 mm say, than layer 25 in this region. In practice it appears that collapse of layer 25 can provide a flared thickness variation towards the junction region.

Use of these embodiments is presently intended to involve location in a shoe with the cavities opening downwardly for closure by the underlying structure, the material of said Specification No. 1,563,195 and U.S. Pat. No. 4,346,204, the latter of which is incorporated herein by reference having a natural tackiness which assists closure of the cavities. However, an additional closure layer of material such as in layer 25 could be employed.

An additional benefit of these embodiments in use is that air is repeatedly vented from the cavities and drawn therein to and from space below and around the foot to ventilate the same. It is also possible to provide passages 22' as shown in FIG. 7 which extend through a side wall of the layer 20 as shown in FIG. 7.

While in the above description more particular reference has been made to application of the invention in footwear, numerous other applications are possible. Reference has already been made to packaging, and other examples are to be found in the medical and veterinary fields where physical shock protection is often appropriate to patients and animals, the automotive field for bumpers, facia panels, seats, crash helmets, etc., and so on.

Also reference has been made primarily to air as the relevant fluid, and air will indeed normally be an optimum choice. However, other fluids of gaseous or liquid form can be employed but will often require use of the structure in association with a closed fluid system, except for marine and other special situations. A possibility of prospective interest is that the role of the fluid may be assumed by a material having non-Newtonian properties in being elastomeric when subjected to forces of low amplitude at high frequency, and as a viscous liquid when subjected to forces of high amplitude at low frequency.

I claim:

1. A shock absorber insole comprising a compressible block of elastomeric material, said block having a cavity formed by surface means defining a recess and adapted to engage shoe surface means when applied to a shoe closing said recess for capturing fluid therein, and viscous damping control means for varying the rate of damping during compression of said block including passage means communicating between said cavity and the exterior of said block through a side wall of said block, said passage means having a cross-section which varies during compression of said block thereby to vary the rate of escape of fluid from said cavity, said elastomeric material being a flexible polyurethane of essentially linear structure containing unsatisfied hydroxyl groups and having a compression set of less than 15%, an elongation at break of at least 500%, and a recovery which is delayed after compression by at least 0.7 seconds.

2. A shock absorbing insole comprising a layer of fluid impermeable elastomeric material having a bottom surface for engaging an interior surface of a shoe, a plurality of elongated narrow recesses formed in said bottom surface, each said recess and the interior shoe surface cooperatively defining a pressurizable fluid-containing cavity, said bottom surface including surface means contiguous with each said recess for sealing against the interior shoe surface thereby to capture fluid within said recess, said elastomeric material being a flexible polyurethane of essentially linear structure containing unsatisfied hydroxyl groups and having a compression set of less than 15%, a elongation at break of at least 500%, and a recovery which is delayed after compression by at least 0.7 second, at least some of said recesses being laterally spaced apart in the direction of the width of the shoe and being in generally parallel relationship.

3. A shock absorbing insole as set forth in claim 2 wherein the width of each said recess is of a similar order of size to the adjacent thickness of said layer of elastomeric material.

* * * * *